US007032406B2

(12) United States Patent
Hollen et al.

(10) Patent No.: US 7,032,406 B2
(45) Date of Patent: Apr. 25, 2006

(54) ICE MACHINE INCLUDING A CONDENSATE COLLECTION UNIT, AN EVAPORATOR ATTACHMENT ASSEMBLY, AND REMOVABLE SUMP

(75) Inventors: Michael C. Hollen, Manitowoc, WI (US); Marty J. Lafond, Algoma, WI (US); Lee G. Mueller, Kewaunee, WI (US); Steven P. Kutchera, Manitowoc, WI (US); Thomas G. Gutman, Reedsville, WI (US); Mathew E. Kampert, Covington, TN (US); Howard G. Funk, Manitowoc, WI (US); Richard T. Miller, Manitowoc, WI (US)

(73) Assignee: Manitowoc Foodservice Companies, Inc., Green Bay, WI (US)

( * ) Notice: Subject to any disclaimer, the term of this patent is extended or adjusted under 35 U.S.C. 154(b) by 0 days.

(21) Appl. No.: 10/913,787

(22) Filed: Aug. 5, 2004

(65) Prior Publication Data

US 2006/0026985 A1 Feb. 9, 2006

(51) Int. Cl.
*F25C 1/12* (2006.01)

(52) U.S. Cl. ..... 62/347; 62/285; 62/298

(58) Field of Classification Search ..... 62/285–291, 62/347, 298, 515–524, 352; 165/76
See application file for complete search history.

(56) References Cited

U.S. PATENT DOCUMENTS 2,473,322 A * 6/1949 Yoxsimer ..... 62/291
2,513,735 A 7/1950 Nardone
2,595,456 A * 5/1952 Hinkel ..... 62/291
2,876,632 A * 3/1959 King ..... 62/285
3,289,430 A 12/1966 Dedricks et al.
3,313,123 A * 4/1967 Ware ..... 62/272
3,407,739 A 10/1968 Myers
3,430,452 A 3/1969 Dedricks et al.
3,678,993 A * 7/1972 Pierce ..... 165/76
4,044,568 A 8/1977 Hagen
4,341,087 A 7/1982 Van Steenburgh
4,366,679 A 1/1983 Van Steenburgh
4,489,567 A 12/1984 Kohl
4,550,576 A * 11/1985 Tate et al. ..... 62/441
4,557,672 A 12/1985 Levine
4,580,410 A 4/1986 Toya (Continued)

OTHER PUBLICATIONS

Publication, Grainger Catalog, 75th Anniversary, p. 3127.

(Continued)

*Primary Examiner*—William E. Tapolcai
(74) *Attorney, Agent, or Firm*—Brinks Hofer Gilson & Lione

(57) ABSTRACT

An ice machine includes an evaporator, a condensate collection unit, positioned below the evaporator and configured to collect condensate from a back surface of the evaporator. First and second mounting brackets attached to the first and second sides of the evaporator, respectively, and are attached to first and second side panels positioned within the ice machine. A pump deck resides below the evaporator and has a chambered section, and a sump is positioned within the chambered section. The condensate collection unit is coupled to a water discharge line, such that condensate is removed from the ice machine and does not come into contact with water that is recirculated to the evaporator. The first and second mounting brackets and first and second flanges on the sump permit easy installation and removal of the evaporator and the sump from the ice machine.

37 Claims, 7 Drawing Sheets

U.S. PATENT DOCUMENTS 4,767,286 A 8/1988 Kohl et al.
4,774,814 A 10/1988 Yingst et al.
4,791,792 A * 12/1988 Naruse et al. ..... 62/135
4,986,088 A 1/1991 Nelson
5,031,417 A 7/1991 Chang
5,042,263 A 8/1991 Day et al.
5,167,132 A 12/1992 Meier
5,289,691 A 3/1994 Schlosser et al.
5,408,834 A 4/1995 Schlosser et al.
5,586,439 A 12/1996 Schlosser et al.
5,722,244 A * 3/1998 Shelton ..... 62/74
5,752,393 A 5/1998 Schlosser et al.
5,924,301 A 7/1999 Cook
5,950,866 A 9/1999 Lancaster
6,116,038 A * 9/2000 Yamada et al. ..... 62/259.1
6,145,336 A * 11/2000 Miller et al. ..... 62/298
6,148,633 A 11/2000 Yamada et al.
6,158,709 A 12/2000 Culp et al.
6,196,007 B1 3/2001 Schlosser et al.
6,234,278 B1 5/2001 Loken et al.
6,705,090 B1 3/2004 Billman et al.
6,705,107 B1 3/2004 Schlosser et al.

OTHER PUBLICATIONS

Publication, Johnstone Supply, Wholesale Catalog #192, pp. 706 and 709.

* cited by examiner

FIG.4
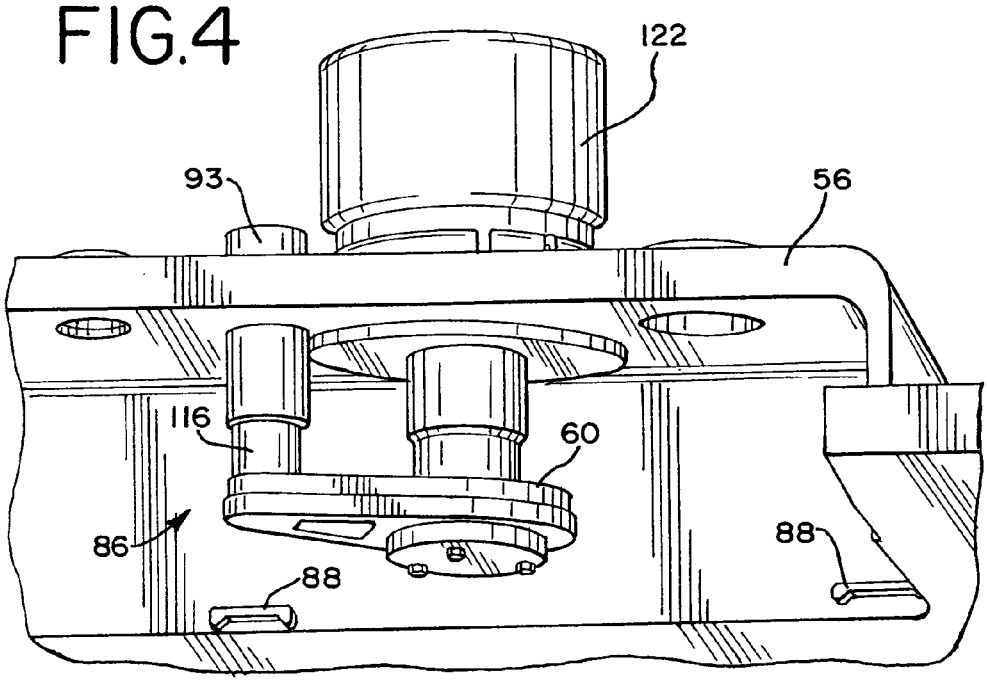
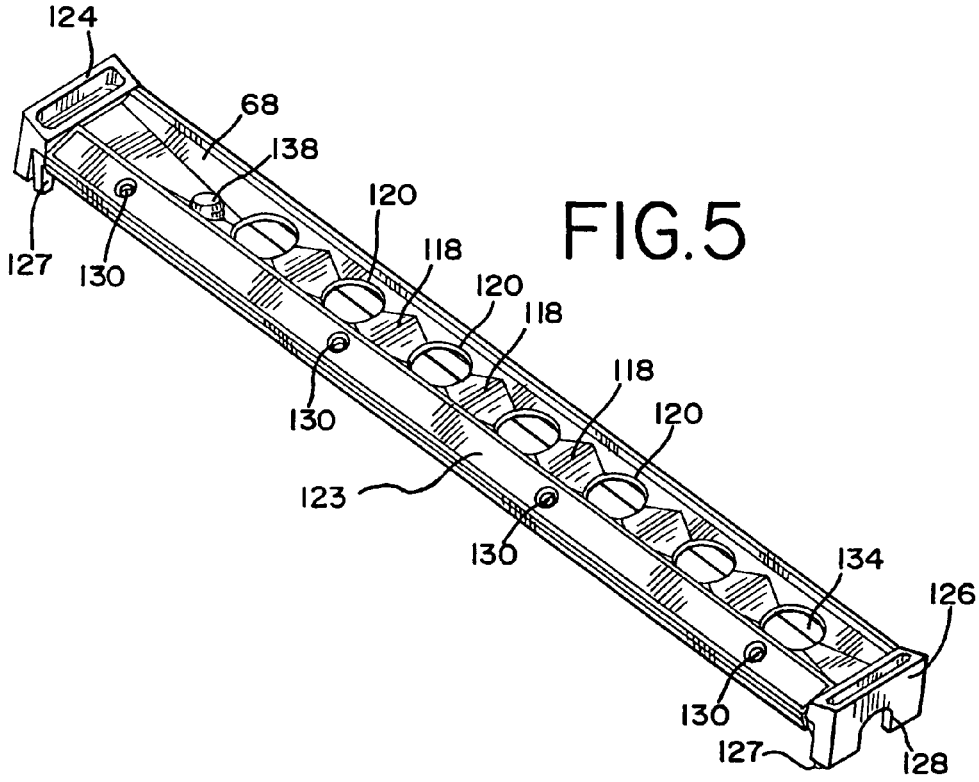
FIG.5

ICE MACHINE INCLUDING A CONDENSATE COLLECTION UNIT, AN EVAPORATOR ATTACHMENT ASSEMBLY, AND REMOVABLE SUMP

TECHNICAL FIELD

The present invention relates to automatic ice making machines and, more particularly, to automatic ice making machines with water recirculation systems and sealed water compartments.

BACKGROUND

Commercial ice making machines are designed to operate continuously and for extended periods of time. To operate efficiently, water must flow rapidly through the machine and high heat transfer rates must be maintained to freeze the water and form ice. Under such operating conditions, any loss of fluid flow or reduction in heat transfer rates can retard ice production and increase the operating cost of the ice machine.

The water recirculation and ice forming systems commonly found in commercial ice making equipment primarily includes a water supply, a water reservoir or water sump, and a means for discarding excess water from the circulating water system, such as a drain or overflow system. A water circulation or recirculation pump or other means is provided for circulating water through the water/ice system. In one type of delivery system, water is pumped to a water distributor for distributing the circulated water across an evaporator plate. In another type of system, water is sprayed onto an evaporator plate. The evaporator plate is usually equipped with a water curtain to direct the water flowing from the water distributor over the evaporator and to distribute unfrozen water back into the water sump. In one type of ice machine, an ice thickness sensing probe for detecting the thickness of the ice formed on the evaporator plate is attached to the evaporator so as to terminate a freeze cycle when sufficient ice is formed and to begin a harvest cycle. In another type of machine, water level sensors are employed to detect when the water level in the water sump falls to a predetermined level, indicating that it is time to harvest the ice.

After the ice has been formed to a desired thickness, a harvest system is initiated, which stops the flow of coolant to the evaporator plate and begins an ice recovery process. To harvest the ice formed on the evaporator, hot refrigerant gas or cool vapor is directed into the evaporator to heat the evaporator plate and release the ice. The ice falls into an ice collector reservoir. An improved harvest system is disclosed in commonly-assigned U.S. Pat. Nos. 6,196,007 and 6,705,107, the disclosures of which are incorporated by reference herein.

Ice making machines that run automatically and for extended periods of time are prone to fouling from environmental sources. During extended use, the water recirculation and ice forming system accumulates soil and water hardness components, such as calcium carbonate and magnesium salts, on the interior surfaces of the system. Occasionally, depending upon the environment in which the ice making machine is located and the quality of the water supplied to the ice making machine, various biological deposits can form, including microbiological growths, yeast residues and slimes. These deposits can possibly become dissolved or entrained in condensate that forms on the evaporator and contaminate the water used to form ice.

Further, soil, water hardness, and biological deposits formed on interior surfaces impede the flow of water through the system and decrease the heat transfer efficiency of the evaporator plate. To maintain operating efficiency the system and sanitary conditions surfaces have to be cleaned to remove the deposits. The cleaning process normally requires dismantling that portion of the ice making machine containing the contaminated surfaces and washing and scrubbing the surfaces using acidic cleaner solutions. After cleaning, care must be taken to rinse the cleaning solution from the surfaces to avoid becoming frozen into the ice that is subsequently formed on the cleaned surfaces. Care must also be taken to avoid contamination of the water supply within the machine that is used to form ice. Then, the machine must be reconstructed. The cleaning process is labor intensive, costly, and inefficient.

To reduce the frequency of disassembly, injection cleaning methods can be used. Injecting cleaning involves injecting an acid solution into the circulating water and manually turning off the coolant system. These cleaning methods can, however, also include auto-cleaning techniques as disclosed in commonly-assigned U.S. Pat. Nos. 5,289,691; 5,408,834; 5,586,439; and 5,752,393, the disclosures of which are incorporated by reference herein. When fouled surfaces are washed with the acidic cleaners, however, the acid comes in contact with metal surfaces, which eats away metal surfaces, such as the evaporator plate. The metal surfaces contain metals and metal alloys that readily conduct heat. Such metals include aluminum, copper, brass, iron, and steel, and the like, all of which tend to corrode on contact with acidic cleaners. Also, cleaner residue can cause the ice formed immediately after such manual cleaning to be of poor quality.

Despite the cleaning techniques described above, contamination of the ice-forming water supply within the ice machine continues to be a problem. This is especially true given the increased sanitary requirements now in place for ice making machines and other commercial food preparation systems. In particular, condensate run-off from the rear of the evaporator continues to challenge machine designers. Left unattended, condensate from the rear of the evaporator simply runs down the back of the evaporator and either collects in machine recesses below the evaporator, or is channeled back into the water sump. While the condensate itself is clean, it forms on the back of the evaporator plate, which is not easily cleaned in most ice making machines. Hence, the condensate can become contaminated. Drain systems have proven difficult to incorporate into the machine and are not completely effective at removing contamination. Attempts to seal the rear side of the evaporator with foam or other hermetic sealing techniques to prevent condensation have proven to be costly and impractical from the stand point of moisture trapping within the sealing material. Simply evaporating the condensate using heat from the on-board ice refrigeration system with additional air circulation has also proven impractical.

BRIEF SUMMARY

In accordance with the invention there is provided, in one embodiment, an ice machine includes a food zone. An evaporator has a front surface positioned within the food zone and a rear surface positioned outside of the food zone. A condensate collection system is configured to collect condensate from the rear surface of the evaporator and drain the condensate away from the food zone.

In accordance with another embodiment of the invention, an ice machine that includes an evaporator having a front side configured to form ice cubes, a back side opposite the front side, and a lower surface. A condensate collection unit is positioned below the evaporator plate and is configured to collect condensate from the back side of the evaporator. A water recirculation system has a water recirculation line and a water discharge line, where an outlet of the condensate collection unit is coupled to the water discharge line.

In yet another embodiment of the invention, an ice machine is provided that includes first and second side panels each having fastener structures therein. An evaporator has a front side configured to form ice cubes and has first and second sides positioned between the first and second side panels, respectively. Mounting brackets are attached to each of the first and second sides of the evaporator. Each mounting bracket has fastener structures therein. The fastener structures in the mounting brackets align with the corresponding fastener structures in the first and second side panels to enable the evaporator to be supported between the first and second side panels.

In still another embodiment of the invention, an ice machine includes a mechanical compartment and a water compartment. A pump deck separates the mechanical compartment from the water compartment. The pump deck has a chambered section. The chambered section has a sidewall and hanger members in the sidewall. First and second side panels are vertically positioned in the mechanical compartment. Each of the first and second side panels has panel hanger structures in an interior surface thereof. A sump having a floor and opposing sidewalls is positioned in the chambered section. First and second flanges extend from the opposing sidewalls and each of the first and second flanges has flange hanger structures therein. The hanger members, the panel hanger structures, and the flange hanger structures support the sump in the chambered section.

In a further embodiment of the invention, an ice machine includes an evaporator having a front, a back, a bottom, and first and second sides. A condensate collection unit is positioned below the bottom of the evaporator and is configured to collect condensate from the back of the evaporator. First and second mounting brackets are attached to each of the first and second sides of the evaporator, respectively. First and second side panels are coupled to each of the first and second mounting brackets, respectively. A pump deck has a chambered section and hanger members positioned in the chambered section. A sump is positioned in the chambered section. The sump has first and second flanges extending from opposite walls of the sump. The first and second flanges are rotationally coupled to the first and second side panels, respectively. The sump is supported in the chambered section by the hanger members and by the first and second flanges.

In a still further embodiment of the invention, a water system for an ice machine includes an evaporator having a front side configured to form ice cubes. Mounting brackets are attached to each side of the evaporator and a water sump is position below the evaporator. A water curtain has side edges positioned adjacent to and spaced away from the front side of the evaporator, where the water curtain provides a surface for excess water to flow to the water sump. Guides reside in a lower portion of each mounting bracket that capture excess water flowing along side edges of the water curtain and return the excess water to the water sump.

In accordance with the embodiments set forth above, the invention provides an ice machine that operates with an improved level of cleanliness. The invention minimizes the contamination of ice formed in the machine through a combination of design features that both prevents contaminated water from being used to form ice, and returns clean water to the water sump. Further, the components of the ice machine are configured to be readily disassembled and reassembled for cleaning and other maintenance procedures by one person using only a minimal number of tools.

BRIEF DESCRIPTION OF THE DRAWINGS

FIG. 4 is a perspective view of a pump deck and pump assembly illustrated in FIG. 2A;

FIG. 5 is an isolated perspective view of an interface plate illustrated in FIG. 3;

DETAILED DESCRIPTION OF THE DRAWINGS AND THE PRESENTLY PREFERRED EMBODIMENTS

Figure 1:
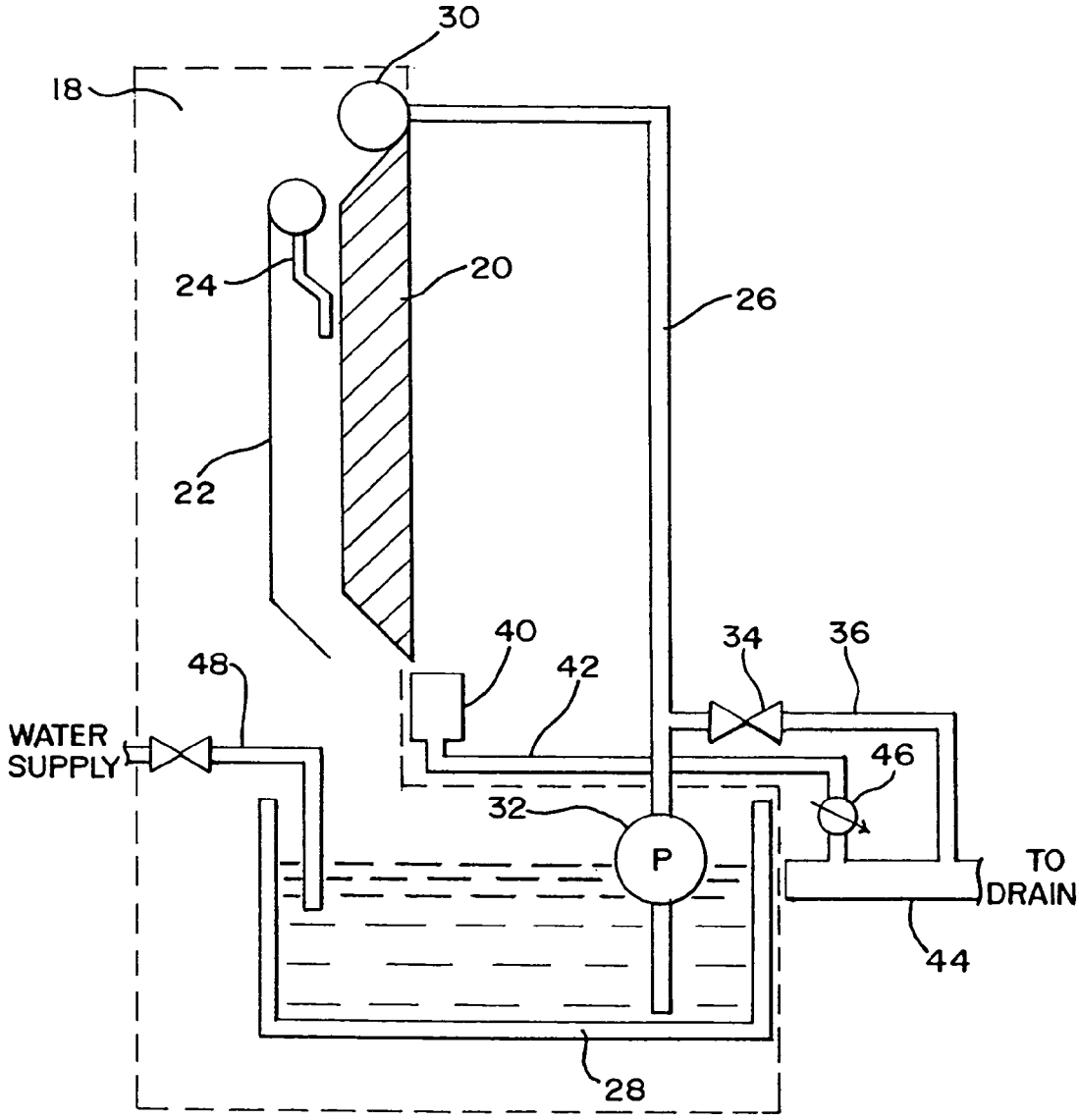
FIG. 1 is a schematic diagram of a condensate collection system and water recirculation system for an ice making unit within an ice machine in accordance with the invention.

Shown in FIG. 1 is a schematic diagram of a water recirculation system, an ice making unit, and a condensate collection system arranged in accordance with the preferred embodiment of the invention. Those skilled in the art will appreciate that the schematic diagram only approximates the physical location of the various components and that the exact relationship of one component to the next can vary from the schematic illustration. The ice making unit includes an evaporator 20, a water curtain 22, and an ice thickness sensor 24. The water recirculation system includes a water recirculation line 26 that recirculates water from a sump 28 to a water distributor 30, and a water pump 32 that pumps water from sump 28 through water recirculation line 26. When it is desired to remove water from sump 28 for cleaning or other purposes, a dump valve 34 in a discharge line 36 can be opened to allow water to be pumped from sump 28 and into a drain. When dump valve 34 is open, water does not flow upward through recirculation line 26 because the pump head pressure is insufficient to overcome the head pressure in recirculation line 26. Alternatively, an on-off valve can be installed in recirculation line 26 where the line sizing and pump pressures differ from the preferred embodiment.

The water collection unit includes a collector 40 positioned below the back side of evaporator 20. Collector 40 is coupled to a condensate discharge line 42. Condensate discharge line 42 is coupled to a discharge collector 44 through a check valve 46. Discharge collector 44 also receives discharge water through discharge line 36. A water supply line 48 supplies fresh water to sump 28 as needed to maintain a sufficient amount of water in sump 28.

In general, the ice machine in which the ice making unit and the condensate collection system are to be installed includes a food zone 18. Food zone 18 is the internal portion of the ice machine that contacts water from which ice is produced for human consumption. The food zone must remain at a predetermined level of cleanliness to meet sanitary requirements imposed on food preparation equipment. The front of evaporator 20, water curtain 22, and ice thickness sensor 24 are within food zone 18. The rear surface of evaporator 20 and the condensate collection system outside of the food zone 18.

In accordance with one aspect of the invention, the condensate collection system is configured to collect water that condenses on the back side of evaporator 20. The condensate collection system delivers the condensate away from food zone 18 and into discharge collector 44 that is, in turn, coupled to a drain system (not shown). By collecting condensate from the back side of evaporator 20, water that condenses on the evaporator does not return to sump 28 or otherwise contaminate food zone 18. By discharging this condensate, the water that is recirculated through water recirculation line 26 does not contain impurities, bacteria, and fouling agents that can be present on the back side of evaporator 20.

In addition to providing for the removal of evaporator condensate, other aspects of the present invention also provide an ice machine having components that can be readily disassembled for cleaning. As will subsequently be described, an ice machine arranged in the accordance with the preferred embodiment of the invention includes an evaporator that can be readily removed from and reinstalled into the ice machine. Further, the preferred embodiment of the invention also provides a sump that can be readily removed from and reinstalled into the ice machine.

Figure 2A:
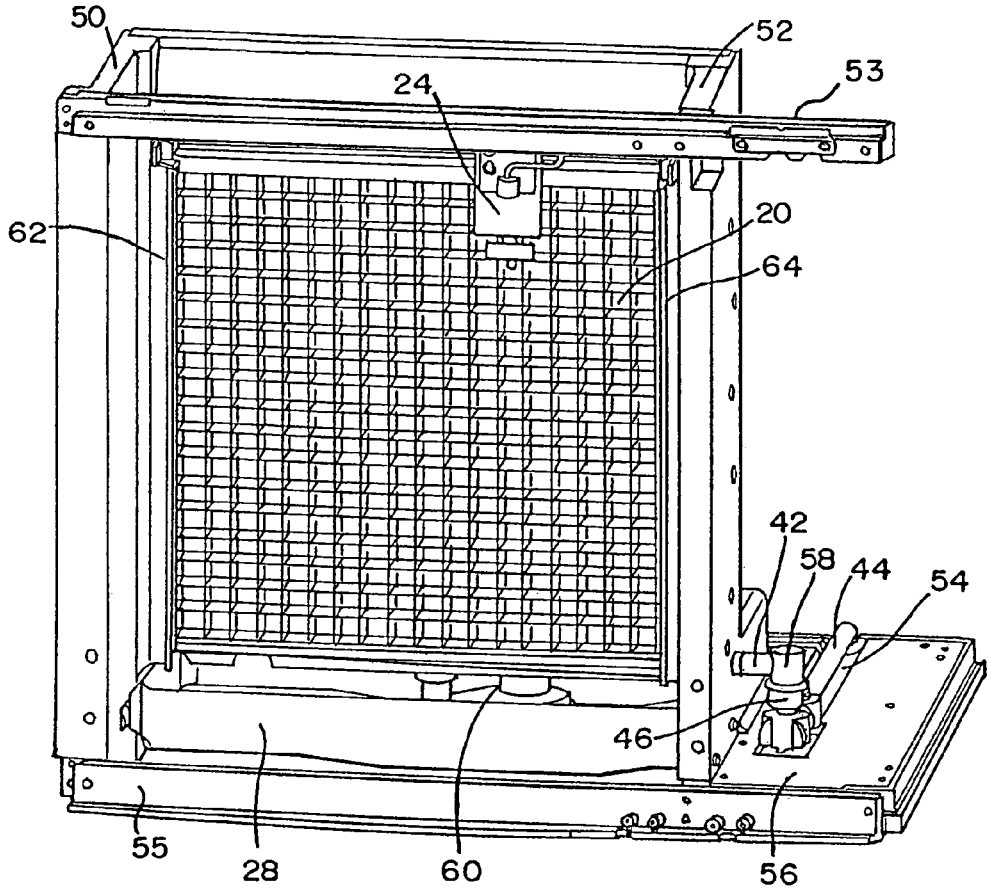
FIG. 2*a* is a perspective view of an ice making unit arranged in accordance with the invention.

FIG. 2A is a perspective view of an ice making unit arranged in accordance with the preferred embodiment of the invention. Evaporator 20 is flanked by first and second side panels 50 and 52, respectively. Water distributor 30 (including parts 74, 76, and 78 shown in FIG. 3) is positioned at the top of evaporator 20 and sump 28 is positioned below evaporator 20. Discharge collector 44 rests in a groove 54 in the upper surface of pump deck 56. Check valve 46 is coupled to condensate discharge line 42 by a coupling 58. An impellor housing 60 is visible below evaporator 20 and is positioned within sump 28. First and second mounting brackets 62 and 64 are attached to the sides of evaporator 20 and are, in turn, connected to first and second side panels 50 and 52, respectively. A top rail 53 and a bottom rail 55 fasten to the top and bottom corners, respectively, of side panels 50 and 52. Bottom rail 55 extends past side panel 52 and is attached to the front of pump deck 56. Top rail 53 also extends past side panel 52 and is configured to attach to a corner post of the ice machine (not shown) and to accommodate portions of a control box (not shown) positioned within the ice machine.

Figure 2B:
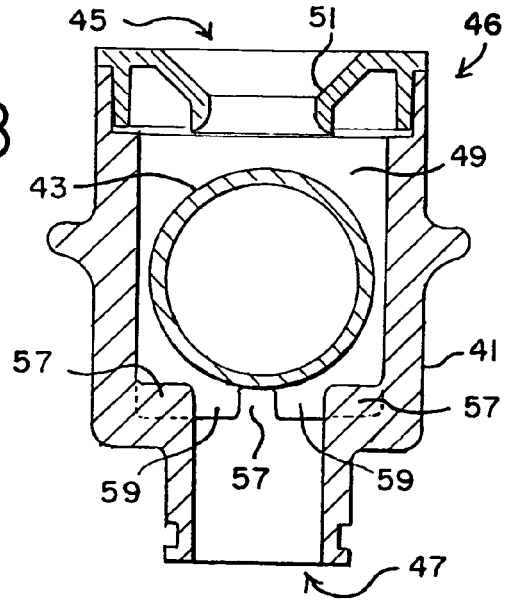
FIG. 2*b* is an cross-sectional view of the check valve illustrated in FIGS. 1 and 2*b* showing internal detail.

A cross-sectional view of check valve 46 is illustrated in FIG. 2B. Check valve 46 includes a tubular housing 41 that confines a ball 43. Condensate water from collector 40 flows from discharge line 42 to an upper opening 45 and out through a lower opening 47. An interior chamber 49 is configured to confine ball 43 within housing 41. Ball 43 is hollow and made of a light-weight material, such that it will float on the surface of water. Interior chamber 49 has sufficient clearance to allow ball 43 to move up and down inside housing 41. Under condensate flow conditions, ball 43 is forced by the discharge water flow into the lower portion of interior compartment 41 where ball 43 rests on feet 57. Feet 57 are preferably arranged at equal distances around the perimeter of lower opening 47. In one embodiment, check valve 46 has four feat spaced at even intervals leaving water channels 59 between feet 57. Accordingly, the discharge water flows around ball 43 and through channels 59 and out lower opening 47 and into discharge collector 44. When stop valve 34 is open and water is pumped out of sump 28 and into discharge collector 44, water that backs up though discharge collector 44 enters check valve 46 though lower opening 47. Ball 43 is hollow and made of a light-weight material, such that it is sufficiently buoyant in the water within interior compartment 41 to remain above lower opening 47 when water fills interior chamber 49. Under the flow of water through lower opening 47, ball 43 is elevated by the water to the upper portion of interior chamber 49 until it is forced against a restriction 51. By tightly pressing against restriction 51 under the water pressure backing up through lower opening 47, ball 43 blocks the flow of water through upper opening 45. Thus, water is prevented from backing up into collector 40 when water is drained from sump 28.

The ice making unit illustrated in FIG. 2A is shown with the water curtain removed in order to better illustrate the functional components of the invention. In operation, during a freeze cycle, water from water distributor 30 flows down the face of evaporator 20 and freezes in the regular array of pockets in the evaporator face. After the freeze cycle is complete, the ice is harvested from evaporator 20 and falls into an ice bin (not shown). The ice is typically harvested as a slab having a grid or framework pattern and the slab breaks up into pieces when the slab falls into the ice bin. The shape of the ice pieces will correspond to the shape of the pockets in the evaporator. The ice is typically cube-shaped; however, other shapes are possible depending upon the pocket geometry. Accordingly, although the term "ice cube" is used herein, this term is intended to describe a variety of ice shapes, such as rectangular, oval, round, cylindrical, and the like.

In accordance with the preferred embodiment of the invention and as described in more detail below, evaporator 20 can be easily removed by detaching first and second mounting brackets 62 and 64 from first and second side panels 50 and 52, respectively. Further, sump 28 can also be readily removed from the ice machine by detaching first and second flexible flanges from first and second side panels 50 and 52.

Figure 3:
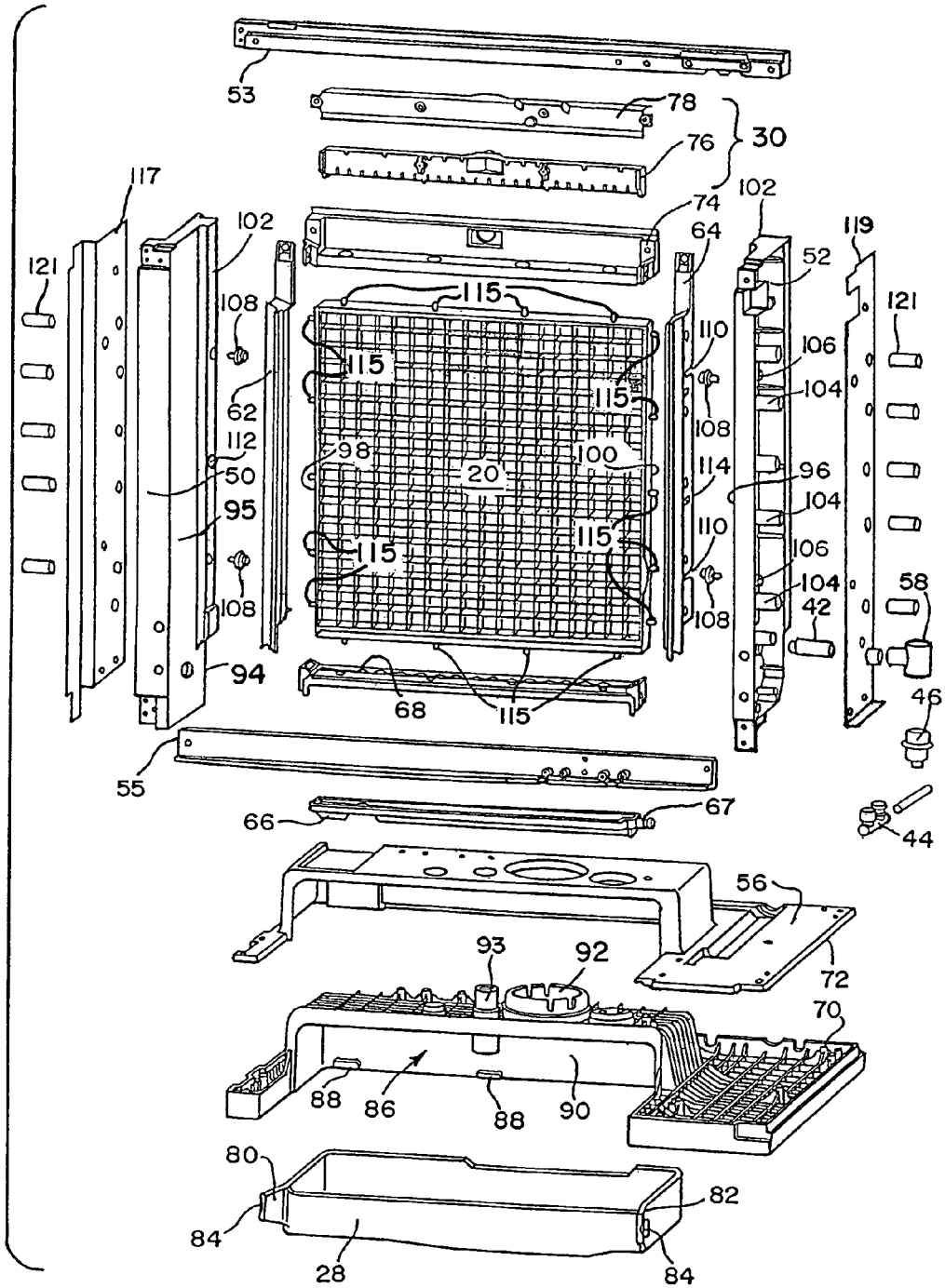
FIG. 3 is an exploded view of the ice making unit illustrated in FIG. 2*a;*

FIG. 3 is an exploded view of several components illustrated in FIG. 2A. The exploded view reveals the detailed construction of collector 40, which includes an elongated trough 66 and an interface plate 68 overlying a trough 66. Also illustrated are first and second side panels 50 and 52, first and second mounting brackets 62 and 64, pump deck 56, water distributor 30, and sump 28. Pump deck 56 includes a structural member 70 and a cover member 72.

Water distributor 30 includes a housing 74, a water trough 76, and a mating member 78. For clarity of illustration, water pump 32 is not shown in FIG. 3. Preferred configurations of the water distributor are disclosed in commonly-assigned, co-pending U.S. patent applications having application Ser. No. 60/599,340 filed on even date herewith, and application Ser. No. 11/192,693 filed Jun. 29, 2005 both entitled "An Ice Machine And Ice-Making Assembly Including A Water Distributor," the disclosures of which are incorporated by reference herein.

Sump 28 includes first and second flexible flanges 80 and 82, respectively. Each of first and second flexible flanges 80 and 82 includes a flange hanger structure 84 at a distal end of each flexible flange. Sump 28 is positioned within a chambered section 86 of pump deck 56. When positioned in chambered section 86, sump 28 rests on hanger members 88 located on a sidewall 90 of chambered section 86. Chambered section 86 also includes a pump opening 92 and a discharge tube 93 in an upper surface of the chambered section.

When placed in position within chambered section 86, the bottom of rear edge of sump 28 rest on hanger members 88. Hanger structures 84 at the terminal ends of flexible first and second flexible flanges 80 and 82 insert into panel hanger structures 94 positioned on inside surfaces 95 and 96 of first and second side panels 50 and 52, respectively.

First mounting bracket 62 is configured to attach to a first side 98 of evaporator 20 and second mounting bracket 64 is configured to attach to a second side 100 of evaporator 20. A plurality of threaded studs 115 extend from first and second sides 98 and 100 and from the top and bottom of evaporator 20. First and second mounting brackets 62 and 64 are configured to meet with seating fixtures 102 embossed into inner surfaces 95 and 96 of first and second side panels 50 and 52, respectively. First and second side panels 50 and 52 include a plurality of guides 104 that accommodate fastening structures for attachment of first and second mounting brackets and evaporator 20 to first and second side panels 50 and 52. First and second side panels 50 and 52 also include housings 106 that provide support for tab 108 from inner surfaces 95 and 96 of first and second side panels 50 and 52, respectively.

First and second mounting brackets 62 and 64 include slots 110 that are configured to receive pegs 108. As will subsequently be described, slots 110 are shaped in a way that permits evaporator 20 to be temporarily positioned between first and second side panels 50 and 52. When so positioned, openings 112 in seating fixtures 102 aligned with fastener structures 114 in first and second mounting brackets 62 and 64. Evaporator 20 can be temporarily positioned between first and second side panels 50 and 52 by suspending evaporator 20 on tabs 108. Once evaporator 20 is positioned, fastening devices can be installed using fastener structures 114 and openings 112 to securely fasten evaporator 20 in the ice machine.

Those skilled in the art will appreciate that the hanger structures enable evaporator 20 to be temporarily positioned in the ice machine and removed from the ice machine by a single service technician. Accordingly, the evaporator can be serviced and cleaned by a single person, thus, reducing the maintenance cost of the ice machine. Although the fastening structures and devices have been described with respect to a particular arrangement in which the mounting brackets include slots and the side panels have pegs, those skilled in the art will recognize that these features can be reversed. In particular, first and second mounting brackets 62 and 64 can include pegs extending therefrom, and first and second side panels 50 and 52 can include slots therein.

Evaporator 20 has a plurality of threaded studs 115 extending from the external sides of the evaporator. In the illustrated embodiment, threaded studs 115 are configured to accommodate nuts (not shown) for attaching evaporator 20 to other components of the assembly. Threaded studs 115 for attaching evaporator 20 to first and second sides 98 and 100 insert through openings 182 (FIGS. 11A and 11B) in mounting brackets 62 and 64. Threaded studs 115 are preferably constructed of metal and are secured to the outer edges of evaporator 20 by spot welding. Alternatively, other means of metal bonding can be used, such as brazing, soldering, metal bonding compounds, and the like.

Outer panels 117 and 119 cover the exterior sides of side panels 50 and 52, respectively. In order to thermally insulate evaporator 20 from the ambient surrounding within the ice machine, after attaching outer panels 117 and 119, foam insulation (not shown) is injected into the interior of side panels 50 and 52. Foam plugs 121 are inserted into guides 104 after attaching evaporator 20 and brackets 62 and 64 to side panels 50 and 52. The foam plugs provide further thermal insulation for evaporator 20. Although five foam plugs for each of first and second side panels 50 and 52 are illustrated in the preferred embodiment of FIG. 3, fewer plugs can be used where it is desired to reduce construction costs. For example, in an alternative embodiment, only two foam plugs are used for each side panel.

In a further aspect of the invention, sump 28 can be readily removed from the ice machine by pressing first and second flanges 80 and 82 toward each other to dislodge hanger structures 84 from panel hanger structures 94. Accordingly, sump 28 can be readily removed from the ice machine for cleaning and then reinstalled without the need for tools or other equipment.

FIG. 4 is a perspective view of a portion of pump deck 56 showing water pump 122 installed in an opening within pump deck 56. Impeller housing 60 is positioned within chambered section 86 and includes a discharge tube 116 coupled to discharge port 93. Discharge port 93 is coupled to water recirculation line 26 (shown in FIG. 1). A more detailed description of the housing and pump deck illustrated in FIG. 4 is disclosed in co-pending, commonly-assigned patent application Ser. No. 10/746,243, filed Dec. 23, 2003, the disclosure of which is incorporated by reference herein.

A perspective view of interface plate 68 is illustrated in FIG. 5. Interface plate 68 couples trough 66 to the bottom surface of evaporator 20. Interface plate 68 includes a plurality of corrugations 118 and a series of openings 120 positioned between each of the plurality of corrugations 118. Interface plate 68 also has a gasket seal 123 integrally formed into the upper surface of interface plate 68. Interface plate 68 further includes first and second attachment fixtures 124 and 126. Attachment fixtures 124 and 126 have guides 127 depending therefrom. Guides 127 assist in aligning elongated trough 66 into position below interface plate 68.

Attachment fixture 126 includes a slot 128 to accommodate outlet 67 of trough 66. A series of opening 130 are positioned along gaskets seal 123 that house brass fittings (not shown) for attachment of interface plate 68 to the bottom surface of evaporator 20.

Figure 6:
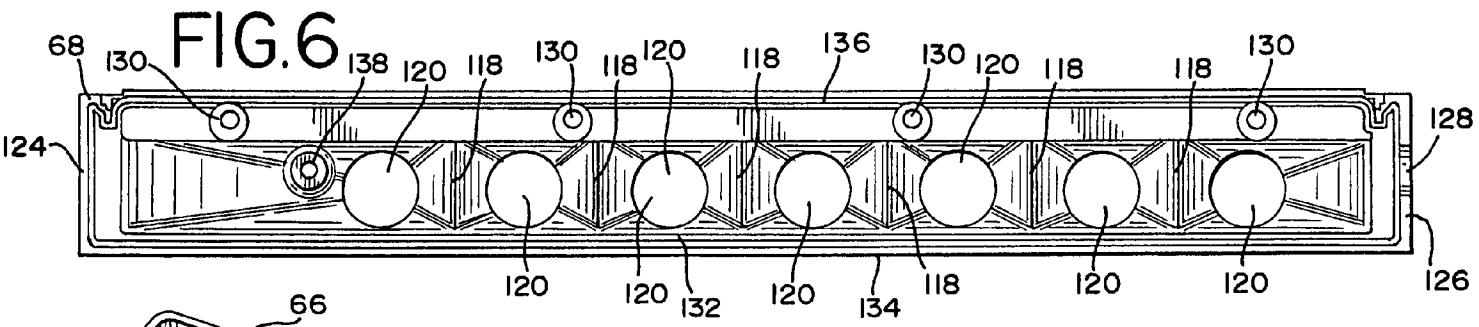
FIG. 6 is a bottom view of the interface plate illustrated in FIG. 5.

FIG. 6 is a bottom view of interface plate 68. A seating surface 132 extends around the perimeter of interface plate 68. Seating surface 132 is positioned between a skirt 134 at a rear portion of interface plate 68 and a lip 136 in a front portion of interface plate 68. Skirt 134 extends below the rear surface and side surfaces of interface plate 68 and elongated trough 66 fits snuggly against seating surface 132. Elongated trough 66 is attached to interface plate 68 by a fastener positioned in housing 138.

Figure 7:
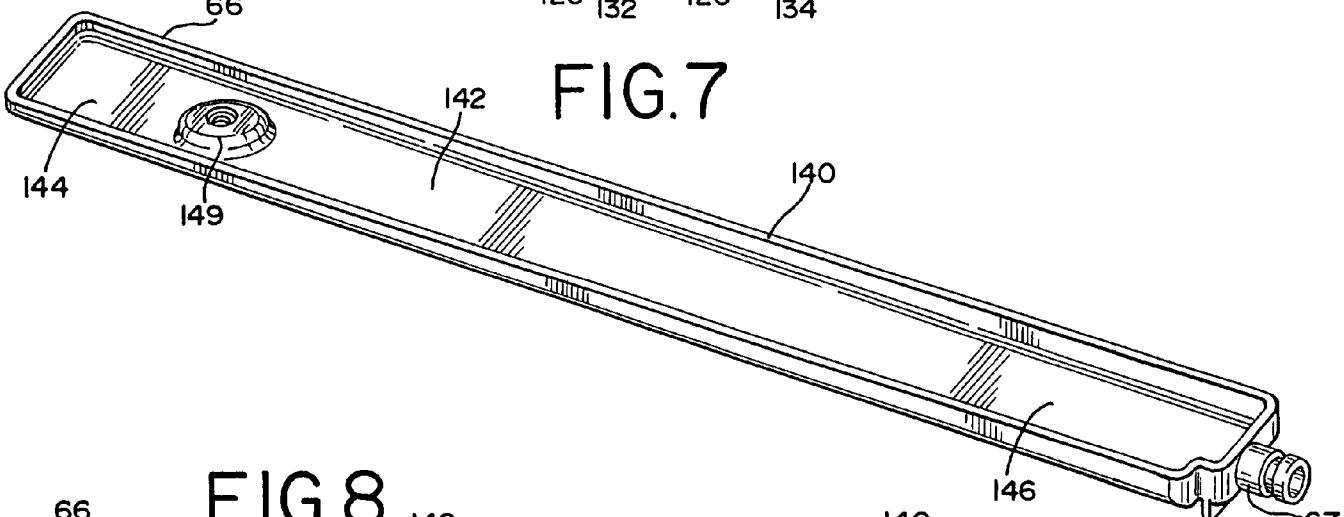
FIG. 7 is an isolated perspective view of the elongated trough illustrated in FIG. 3.

A perspective view of trough 66 is illustrated in FIG. 7. Trough 66 has a wall 140 extending around the perimeter of trough 66. Wall 140 abuts against seating surface 132 in the bottom surface of interface plate 68. Wall 120 is integrally formed with a floor 142. The vertical height of wall 140 above floor 142 varies along the lateral extent of floor 142. Accordingly, trough 66 has a shallow end 144 opposite from outlet 67 and a deep end 146 proximate to outlet 67. Accordingly, the configuration of trough 66 encourages the flow of condensate coming from the back side of evaporator 20 to flow toward outlet 67. Trough 66 also includes a vertical member 148 that depends from floor 142 below outlet 67. Vertical member 148 aligns with guide 127 when trough 66 is mated with interface plate 68.

Figure 8:
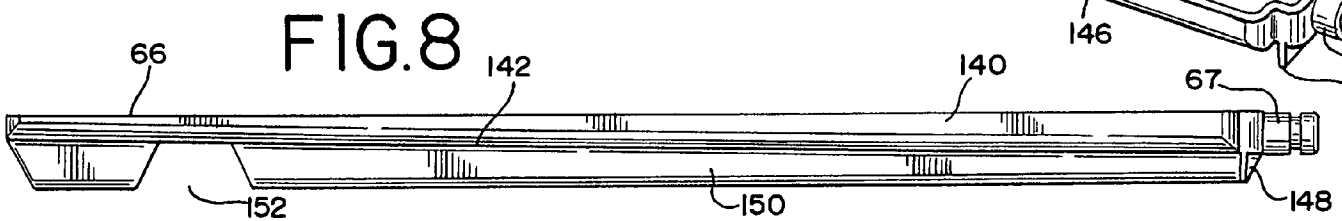
FIG. 8 is a side view of the elongated trough illustrated in FIG. 7.

A side view of trough 66 is shown in FIG. 8. A water foil 150 extends below floor 142. A gap 152 in water foil 150 permits access to raised opening 149. The gap assists the attachment of a fastening device during assembly of trough 66 to interface plate 68. Water foil 150 is configured to direct water from the front side of evaporator 20 to sump 28.

Figure 9A:
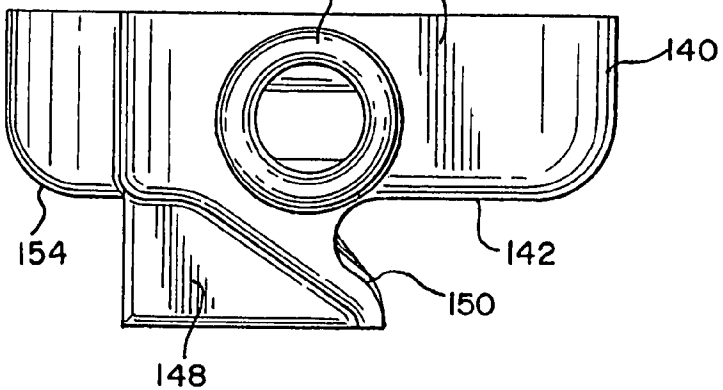
FIG. 9A is an end view of the elongated trough illustrated in FIG. 7.
Figure 9B:
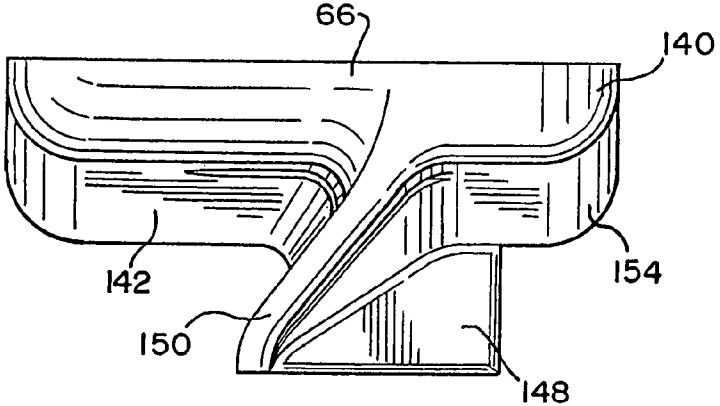
FIG. 9B is a perspective view of the opposite end of the elongated trough illustrated in FIG. 9A.

An end view of trough 66 showing outlet 67 is illustrated in FIG. 9A. An end view of trough 66 at the end opposite outlet 67 is illustrated in FIG. 9B. In the illustrated embodiment water foil 150 is shaped to resemble a "whale tail" that depends from floor 142 of trough 66. When installed in the ice machine, residual water that does not freeze on the evaporator can flow down a front side 154 of trough 66 and be directed by water foil 150 into sump 28. In addition to directing the water that is intended for ice formation into sump 28, trough 66 also directs water that condenses on the front side of the evaporator, which is also clean water, into sump 28.

Figure 10:
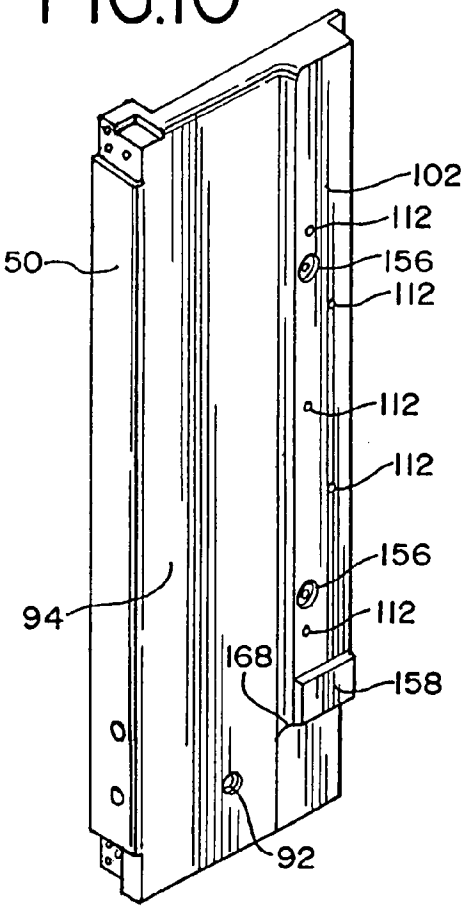
FIG. 10 is an isolated perspective view of a side panel illustrated in FIG. 3.

A perspective view of first side panel 50 is illustrated in FIG. 10. The positioning of openings 112 along seating fixture 102 are shown to be staggered relative to one another. Also shown in FIG. 10 are recesses 156 that accommodate tabs 108. A pedestal 158 protrudes from a lower end portion of seating fixture 102. Pedestal 158 provides support for first mounting bracket 62. Structure corresponding to that shown on inside surface 95 of first side panel 50 is also present on inside surface 96 of second side panel 52.

Figure 11A:
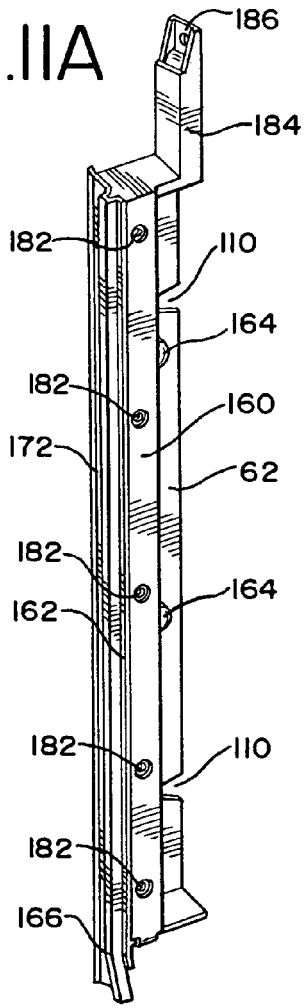
FIG. 11A is an isolated perspective view of the left mounting bracket illustrated in FIG. 3.

A perspective view of first mounting bracket 62 is illustrated in FIG. 11A. A gasket seal 160 is integrally formed into an inside surface 162 of first mounting bracket 62. Gasket seal 160 seals against first side 98 of evaporator 20 when first mounting bracket 62 is attached to evaporator 20. First mounting bracket 62 also include housings 164 that accommodate fasteners inserted through guides 104 and openings 112 in first and second side panels 50 and 52. First mounting bracket 62 also includes a guide 166 that abuts against pedestal 158. Guide 166 channels water flowing down the outside edges of water curtain 22 into sump 28. When positioned on sitting fixture 102, the lower portion of guide 166 forms a continuous semi-circular curve with curved portion 168 of pedestal 158.

Figure 11B:
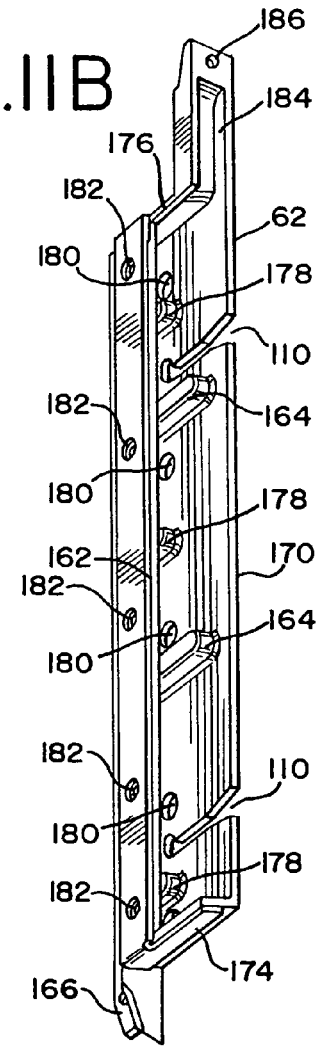
FIG. 11B is an isolated perspective view of an opposite side of the mounting bracket illustrated in FIG. 11A.

A perspective view of the opposite side of first mounting bracket 62 is illustrated in FIG. 11B. Inside surface 162 is displaced away from an outside surface 170 by a wall 172. Thus, inside surface 162 forms a shelf that extends from a lower end 174 to an upper end 176 of first mounting bracket 62. The hollow region between surface 162 and outside surface 170 accommodates housings 164 and housings 178. Inside surface 170 also includes opening 180 that are aligned with openings 182 and inside surface 162. Openings 180 permit access by a tool when attaching first mounting bracket 62 to first side 98 of evaporator 20. A fastening device, such as a screw, can be inserted through openings 182 and into the side surface of evaporator 20 to secure first mounting bracket 62 to evaporator 20 prior to installing evaporator 20 in the ice machine.

First mounting bracket 62 has a bracket extension 184 with an opening 186 in a terminal end thereof. Bracket extension 184 permits first mounting bracket 62 and evaporator 20 to be secured to a lateral cross member in the ice machine.

Second mounting bracket 64 includes features identical to those of first mounting bracket 62 shown in FIGS. 11A and 11B and described above. In accordance with the preferred embodiment, first and second mounting brackets 62 and 64 are mirror images of one another. Although first and second mounting brackets 62 and 64 are described with respect to specific geometric features, those skilled in the art will appreciate that other configurations of first and second mounting brackets 62 and 64 are possible. For example, first and second mounting brackets 62 and 64 can have structures that accommodate various types of fastening devices, such as bolts, pins, snap fittings, and like. In accordance with the preferred embodiment of the invention, first and second mounting brackets 62 and 64 are contoured in a way that directs water coming off water curtain 22 to flow toward the bottom of evaporator 20 and into sump 28. The detailed design of a preferred water curtain for use with the invention disclosed herein is set forth in commonly-assigned U.S. patent application having application Ser. No. 10/913,011 entitled "Ice-Making Machine With Contoured Water Curtain" and filed on even date herewith, the disclosure of which is incorporated by reference herein.

Although the contoured features of the illustrated embodiment are particularly well suited to directing excess water from water curtain 22, other shapes are possible. The amount that can operate to contain excess water within the space defined by the evaporator and the water curtain.

Figure 12:
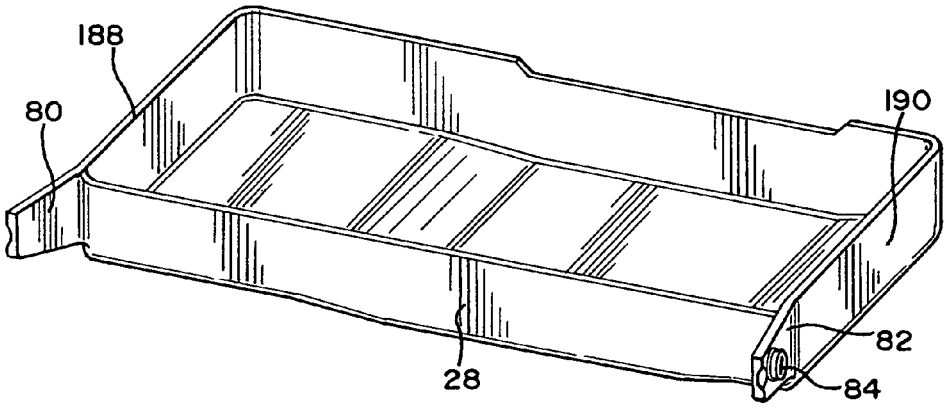
FIG. 12 is an isolated perspective view of the sump illustrated in FIG. 3.

FIG. 12 illustrates a perspective view of sump 28. Sump 28 includes first side wall 188 and second side wall 190. First and second flanges 80 and 82 extend from first and second side walls 188 and 190, respectively. First and second flanges 80 and 82 are bowed outward with respect to first and second side walls 188 and 190, respectively. By angling first and second flanges 80 and 82 in an outward direction, lateral pressure is exerted on panel hanger structures 94 by the flanges. The lateral pressure assist in holding sump 28 in place within chambered section 86 of pump deck 56. In the preferred embodiment of the invention, first and second flanges 80 and 82 are angled out at about 11° with respect to first and second sidewalls 188 and 190. In accordance with the illustrated embodiment, hanger structures 84 and panel hanger structures 94 form a ball and socket joint. Accordingly, sump 82 can be rotated over a fixed range of motion about hanger structures 84.

The ability to rotate sump 28 about hanger structures 84 assists in removing and reinstalling sump 28 from the ice machine. Further, first and second flanges 80 and 82 are preferably constructed of molded plastic. Accordingly, first and second flanges 80 and 82 are flexible and can be bent toward one another to disengage hanger structures 84 from panel hanger structures 94. Those skilled in the art will recognize that other methods of temporarily attaching sump 28 to first and second side panels 50 and 52 are possible. For example, various types of brackets, pegs, snap fittings, and the like, can also be used.

Accordingly, the ice machine described above includes several features that permit easy cleaning and provide improved sanitary operation. The design configuration and mounting attachments of the various water handling components of the ice machine can be easily removed and cleaned in an on-site cleaning system, such as a dish washer and the like. Thus, the ice machine described herein offers a feature known in the art as "top shelf cleanability." Further, by providing a condensate collection system, water that condenses on the back side of the evaporator is removed from the machine without contaminating the food compartment within the machine.

Thus, it is apparent that there has been described in accordance with the invention an ice machine including a condensate collection unit, a water recirculations system, an evaporator attachment assembly, and a removable sump that provides the advantages set forth above. Those skilled in the art will recognize, however, that variations and modifications can be made without departing from the spirit of the invention. For example, various geometric configurations of the condensate collection unit, the evaporator mounting assembly, and the removable sump are possible. Accordingly, it is intended that all such variations and modifications be included within the appended claims and equivalence thereof.

The invention claimed is:

1. An ice machine comprising:

(a) a food zone;

(b) an evaporator having a front surface positioned within the food zone and a rear surface positioned outside of the food zone;

(c) a condensate collection system configured to collect condensate from the rear surface of the evaporator and drain the condensate away from the food zone; and (d) a water system configured to deliver water to the front surface of the evaporator.

2. The ice machine of claim 1 wherein the condensate collection system comprises a collector positioned below the evaporator and coupled to a condensate discharge line that directs the condensate to a discharge collector.

3. The ice machine of claim 2 further comprising a check valve positioned within the condensate discharge line that prevents water being discharged from the food zone after a freezing cycle from flowing into the condensate discharge line.

4. The ice machine of claim 3 wherein the check valve comprises:

(a) a housing having an inlet and an outlet;

(b) a ball within the housing, the ball having sufficient buoyancy to float on water; and (c) structure within the housing that cooperates with the ball to allow the flow of water from the inlet through the outlet, but stops the reverse flow of water from the outlet though the inlet.

5. An ice machine comprising:

(a) an evaporator having a front side configured to form ice cubes, a back side opposite the front side, and a lower surface;

(b) a condensate collection unit positioned below the evaporator and configured to collect condensate from the back side of the evaporator, the collection unit having an outlet; and (c) a water system having a water recirculation line and a water discharge line, wherein the outlet is coupled to the water discharge line.

6. The ice machine of claim 5 wherein the condensate collection unit comprises:

(a) an elongated trough having the outlet positioned at one end of the trough; and (b) an interface plate overlying the elongated trough, the interface plate having a lower surface engaging the elongated trough and an upper surface adjacent to the lower surface of the evaporator.

7. The ice machine of claim 6 wherein the interface plate comprises a corrugated plate having a series of openings therein in spaced relationship to the corrugations, and wherein the upper surface includes a gasket seal integral with a portion thereof that forms a seal with a portion of the lower surface of the evaporator.

8. The ice machine of claim 5 wherein the outlet is coupled to the water discharge line by a water pathway that comprises a check valve and a coupling attached to the water discharge line.

9. The ice machine of claim 8 further comprising a water sump positioned below the condensate collection unit and configured to collect water from the front side of the evaporator.

10. The ice machine of claim 9 further comprising a water pump having an intake positioned in the water sump and a discharge port coupled to the water recirculation line.

11. The ice machine of claim 10 further comprising:

a pump deck supporting the water pump;

wherein the water pump comprises a pump motor and an impeller housing, wherein the intake is located in the impeller housing, and wherein the pump deck is configured to support the water pump such that the pump motor resides above the pump deck and the impeller housing resides below the pump deck.

12. The ice machine of claim 10 further comprising a stop valve in the recirculation line wherein the stop valve in a closed position diverts water from the discharge port to the water discharge line.

13. The ice machine of claim 12 wherein the coupling comprises a first port and a second port, wherein the first port is coupled to water recirculation line at a position upstream from the stop valve, and wherein the second port is coupled to the check valve.

14. The ice machine of claim 8 wherein the condensate collection unit further comprises a water foil extending from a bottom surface thereof and configured to direct water from the front side of the evaporator to the water sump.

15. The ice machine of claim 5 wherein one or more components of the condensate collection unit and the water recirculation system comprise molded plastic components having an antimicrobial additive.

16. An ice machine comprising:

(a) first and second side panels each having fastener structures therein;

(b) an evaporator having a front side ice molding surface configured to form ice cubes and having first and second sides positioned between the first and second side panels, respectively;

(c) mounting brackets attached to each of the first and second sides of the evaporator;

(d) each mounting bracket having fastener structures therein, wherein the fastener structures in the mounting brackets align with corresponding fastener structures in the first and second side panels to enable the evaporator to be supported between the first and second side panels.

17. The ice machine of claim 16 wherein the mounting brackets further include a slot configured to receive pegs extending from each of the first and second side panels, and wherein the slot is further configured to allow manipulation of the evaporator, such that the evaporator can be temporarily supported between the first and second panels.

18. The ice machine of claim 16 wherein the mounting brackets further include pegs extending therefrom and wherein the first and second side panels include a slot configured to receive pegs extending from the mounting brackets, and wherein the slot is further configured to allow manipulation of the evaporator, such that the evaporator can be temporarily supported between the first and second panels.

19. The ice machine of claim 16 wherein the mounting brackets further comprise a gasket integral with a inner surface portion of each mounting bracket and forming a seal between each mounting bracket and an adjacent one of the first or second sides of the evaporator.

20. The ice machine of claim 16 wherein the fastener structures in the mounting brackets and in the first and second side panels comprises openings configured to receive a fastening device.

21. The ice machine of claim 20 wherein the fastening device comprises molded plastic screws.

22. The ice machine of claim 16 wherein the mounting brackets each comprise an elongated molded plastic body having an outer surface contoured to mate with seating fixtures embossed in a corresponding first or second side panel.

23. The ice machine of claim 16 wherein the slot comprises a first slot located at near an upper end of each mounting bracket and a second slot located near a bottom end of each mounting bracket.

24. The ice machine of claim 16 wherein one or more components of the ice machine comprise molded plastic components having an antimicrobial additive.

25. An ice machine having a water sump that can be easily removed without the use of tools, the ice machine comprising:

(a) a mechanical compartment and a water compartment;

(b) a pump deck separating the mechanical compartment from the water compartment, (c) the pump deck having a chambered section with a sidewall and hanger members in the sidewall;

(d) a sump positioned in the chambered section, the sump having a floor and opposing sidewalls;

(e) first and second flanges extending from the opposing sidewalls; and (f) flange hanger structures in each of the first and second flanges that engage support structures within framing members of the ice machine, wherein the hanger members and the flange hanger structures support the sump in the chambered section.

26. The ice machine of claim 25 wherein the hanger members and the flange hanger structures are configured such that the sump can be removed from the ice machine without the use of tools.

27. The ice machine of claim 25 wherein the hanger members comprise tabs projecting from the sidewall and underlying a peripheral portion of the floor of the sump.

28. The ice machine of claim 25 wherein the support structures within framing members comprise sockets in an inner surface of first and second vertical panels, and wherein the flange hanger structures comprise shafts extending from each flange and into the socket in an adjacent one of the first or second vertical panels.

29. The ice machine of claim 28 wherein the flanges are configured such that the shafts exert a lateral force upon the sockets.

30. The ice machine of claim 25 wherein the framing members and the flange hanger structures are configured such that the sump can be lowered from the chambered section by rotating about an axis extending though the panel hanger structures and the flange hanger structures.

31. The ice machine of claim 30 wherein the sump can be removed from the ice machine by lowering the sump from the chambered section and pressing the first and second flanges toward one another.

32. An ice machine comprising:

(a) an evaporator having a front, a back, a bottom, and first and second sides;

(b) a condensate collection unit positioned below the bottom of the evaporator and configured to collect condensate from the back surface of the evaporator;

(c) first and second mounting brackets attached to each of the first and second sides of the evaporator, respectively;

(d) first and second side panels coupled to each of the first and second mounting brackets, respectively;

(e) a pump deck having a chambered section and hanger members positioned in the chambered section;

(f) a sump positioned in the chambered section, the sump having first and second flanges extending from opposite walls of the sump and rotationally coupled to the first and second side panels, respectively, wherein the sump is supported in the chambered section by the hanger members and by the first and second flanges.

33. The ice machine of claim 32 further comprising:

(a) a water curtain having side edges and positioned adjacent to and spaced away from the front side of the evaporator, wherein the water curtain provides a surface for excess water to flow to the sump; and (b) guides in a lower portion of each mounting bracket that capture excess water flowing along the side edges of the water curtain and return the excess water to the water sump.

34. The ice machine of claim 32 wherein the first and second mounting brackets have slots receiving pegs protruding from each of the first and second side panels, such that the evaporator can be temporarily positioned between the first and second side panels prior to coupling the first and second mounting brackets to the first and second side panels, respectively.

35. The ice machine of claim 32 wherein the first and second flanges comprises flexible flanges, and wherein the sump can be decoupled from the first and second side panels by pressing the first and second flanges toward one another.

36. The ice machine of claim 1 wherein the water system further comprises a water recirculation line and a water discharge line.

37. The ice machine of claim 36 further comprising a discharge collector coupled to the water discharge line and to the condensate collection system.

* * * * *